United States Patent [19]

Wolff et al.

[11] Patent Number: 4,522,136

[45] Date of Patent: Jun. 11, 1985

[54] METHOD AND APPARATUS FOR RETARDING OIL LEAKAGE IN A SEWING MACHINE

[75] Inventors: James W. Wolff, Chicago; James W. Ruedisueli, Des Plaines; Ralph Schinke, Chicago, all of Ill.

[73] Assignee: Union Special Corporation, Chicago, Ill.

[21] Appl. No.: 557,088

[22] Filed: Dec. 1, 1983

[51] Int. Cl.[3] ..... D05B 71/00

[52] U.S. Cl. ..... 112/256; 384/134

[58] Field of Search ..... 184/1 R, 135, 6.4; 277/3, 27; 384/138, 134; 112/256; 415/112, 176

[56] References Cited

U.S. PATENT DOCUMENTS

| | | | |
|---|---|---|---|
| 1,037,647 | 9/1912 | London | 277/3 |
| 2,159,057 | 5/1939 | Sterrett | 384/134 X |
| 2,378,452 | 6/1945 | Vincent | 415/112 |
| 3,144,035 | 8/1964 | Hablanian et al. | 277/3 |
| 3,302,951 | 2/1967 | Olesen | 415/175 X |
| 3,418,955 | 12/1968 | Attwood et al. | 112/256 |
| 3,477,385 | 11/1969 | Tangeman et al. | 415/112 |
| 3,869,235 | 3/1975 | Moore | 277/27 |
| 4,350,345 | 9/1982 | Kalan et al. | 277/3 |
| 4,419,948 | 12/1983 | von Hagen | 112/256 |

FOREIGN PATENT DOCUMENTS

| | | | |
|---|---|---|---|
| 510513 | 12/1920 | France | 277/135 |

*Primary Examiner*—Werner H. Schroeder
*Assistant Examiner*—Andrew M. Falik
*Attorney, Agent, or Firm*—John W. Harbst; John A. Schaerli

[57] ABSTRACT

The atmospheric pressure of lubricant containing cavities, from which leakage occurs, is lowered to a point below atmospheric pressure such that air from the environment is drawn thereinto. Since the air being drawn in occupies the passages through which lubricant leakage occurs, such leakage is effectively retarded.

9 Claims, 3 Drawing Figures

METHOD AND APPARATUS FOR RETARDING OIL LEAKAGE IN A SEWING MACHINE

BACKGROUND OF THE INVENTION

This invention is related to the retardation of lubricant leaks in machinery and in particular to lubricant leaks in industrial sewing machines.

Oil leakage is a problem with machines which have inner oil containing cavities, and moving devices which extend from these cavities through the walls of the frame into the surrounding environment. Gasket junctures also present problems with lubricant leakage to various degrees.

To solve such problems, the prior art contains gaskets of many different shapes, forms, materials, etc. The same is true of seal devices. The problems are compounded by moving devices which extend through the walls of the frame, since very often because of unique configurations, specifically designed seals or gaskets are required. This being reflected back in the cost of the final product.

Accordingly, there is a need for a means which will effectively retard the leakage of lubricant to the exterior of the device regardless of its source.

SUMMARY OF THE INVENTION

The invention hereunder consideration involves machines that have a frame and at least one generally sealed inner cavity from which lubricant leakage occurs. The invention being: the lowering of the atmospheric pressure within the inner cavity below that of the atmosphere by any suitable means, such as a vacuum pump, until air from the environment is drawn into the cavity through the passages from which the lubricant is leaking. In so doing, the inflowing air, replaces the lubricant at all leakage points, thus retarding the outward passage thereof.

DETAILED DESCRIPTION OF THE INVENTION

Figure 1:
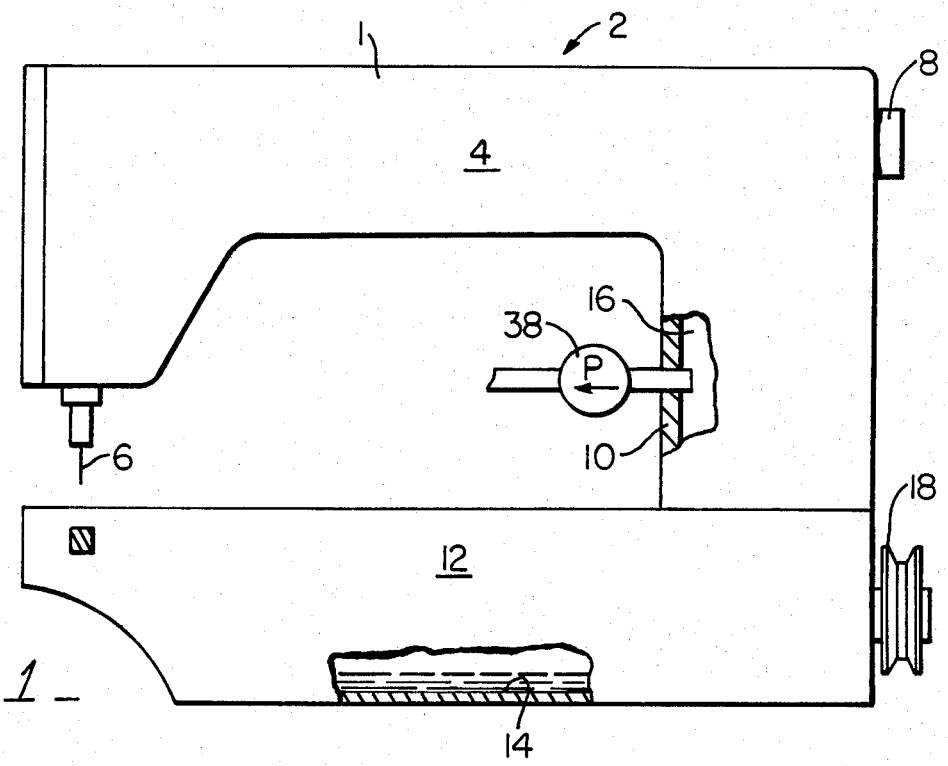
FIG. 1 is a front view of a sewing machine incorporating the present invention.

First referring to FIG. 1 wherein is shown a sewing machine of the type manufactured by Union Special Corporation, 400 North Franklin Street, Chicago, Ill. and identified as Style XF511H100MF catalog no. 142M First Edition. It is understood that this is simply one embodiment of the invention which is applicable in general to machines having lubricant or oil containing inner cavities which suffer from leaks. Such leaks can take the form of any passage or permation through, around, across, etc. seals, bushings, gasket material, etc.

Figure 3:
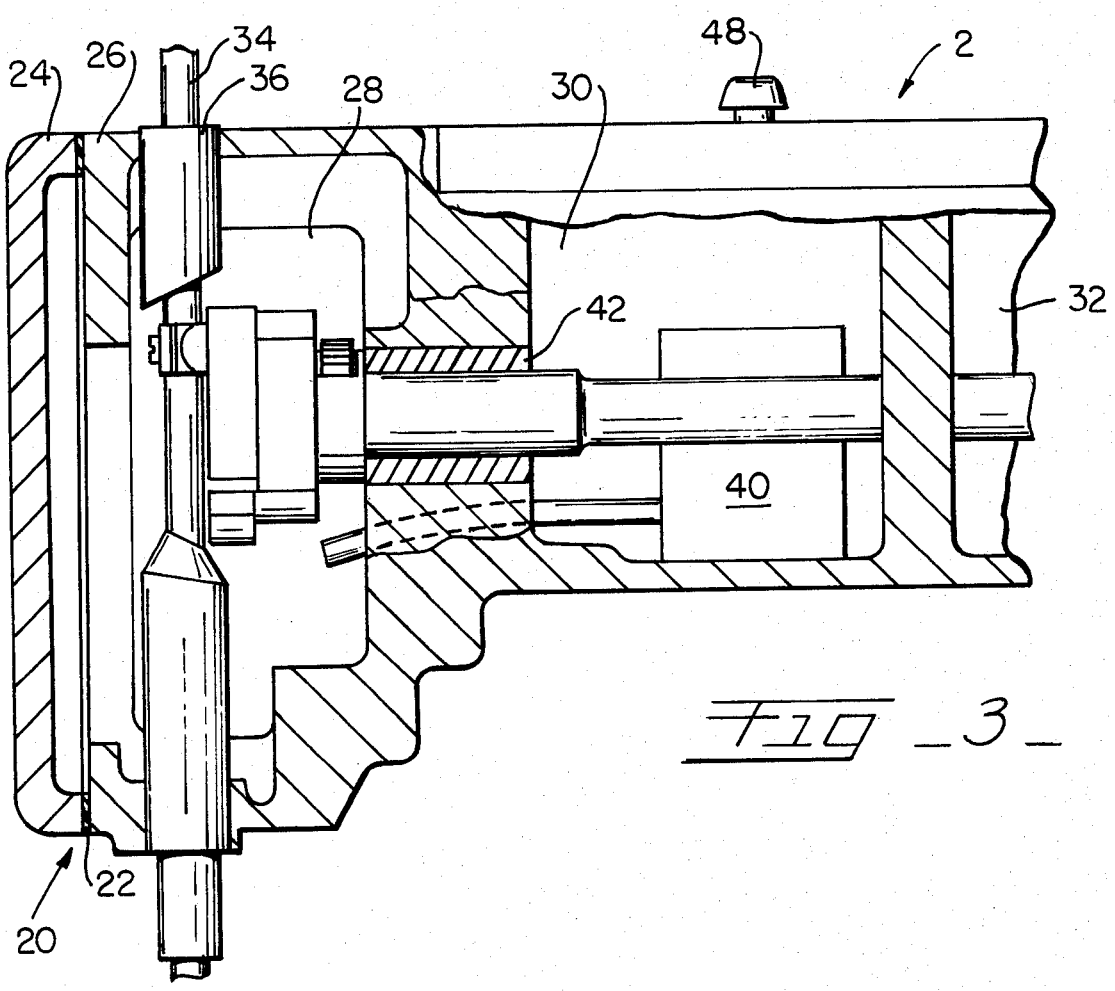
FIG. 3 is a partial sectional view of the left portion of upper arm showing a device which passes from an inner lubricant containing cavity through the wall of the frame.

As stated, FIG. 1 shows the frame or body portion 1 of a sewing machine means 2 which includes: an upper arm means 4, a needle means 6 defining a sewing area or zone, a hand wheel 8, a frame wall means 10, a lower arm means 12, an oil sump means 14 containing oil and an inner cavity means 16. A drive shaft pulley means 18 cooperates with a belt and a motor (not shown) to transfer driving force to the sewing machine. In general, the inner cavity or cavities is/are sealed against lubricant leakage into the environment surrounding the machine. Referring to FIG. 3, such leakage can take place through or across gasket juncture means 20 which includes a gasket means 22 sandwiched between the removably arranged cover means 24 of the hollow or open front section 26 of the sewing machine frame 2. As is known in the prior art, the interior of a sewing machine frame may have a single inner cavity or may include a plurality of inner cavities such as 28, 30 and 32 in FIG. 3. These open cavities such as 28, 30 and 32 can contain various amounts of lubricant and are sealed against leakage of lubricant via cover means which cooperate with the machine frame to sandwich a gasket means. However, retarding the leakage of lubricant through said gasket junctures and around lubricated device means disposed substantially proximate the sewing zone, such as the needle bar 34 and bushing 36 which extend from the machine interior through and beyond the machine frame into the surrounding environment is not so simple. Gasket material is known to be semipermeable and lubricant leakage passages are known to exist around bushings, bearings, seals, etc. All of which leakage problems are evidenced by the presence of lubricant in the environment surrounding the machine frame. The various means or mode whereby the lubricant finds its way to the surrounding environment is beyond the scope of this invention and thus will only be speculated upon.

What we have discovered is that if the atmospheric pressure within the machine interior is reduced sufficiently below that of the surrounding environment, air will be inwardly drawn to the machine's interior through the means, mode, passages, etc. through which the lubricant was prior therefrom leaking to produce an air seal.

Figure 2:
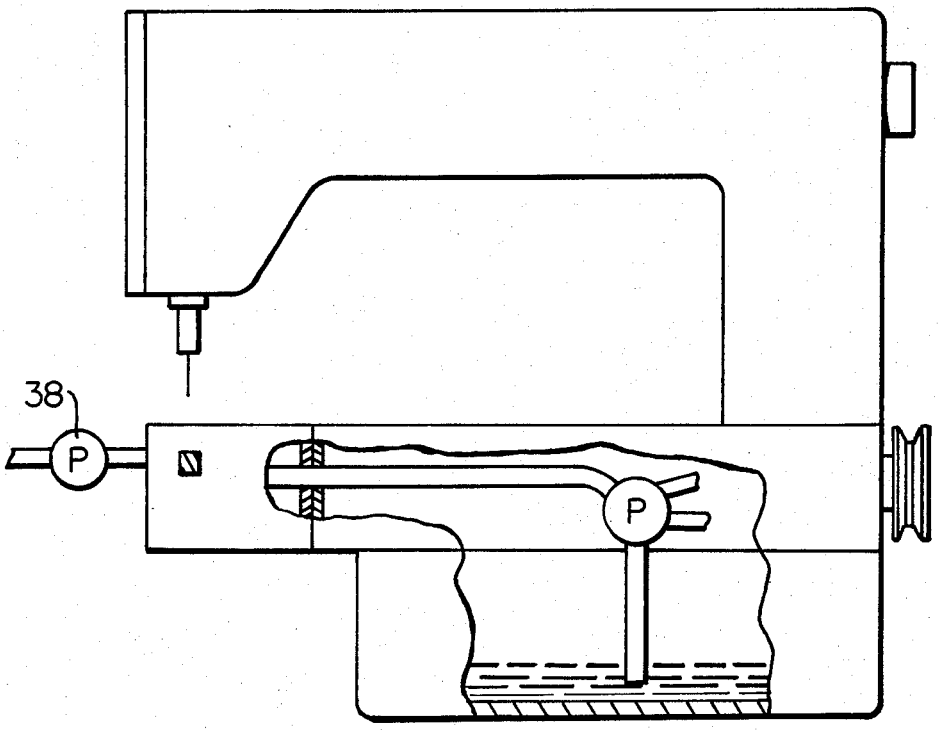
FIG. 2 is a front view of a sewing machine partially broken away showing a pump means located within an inner cavity of the sewing machine.

Any type of means for reducing the atmospheric pressure may be employed such as a vacuum pump 38 or a venturi means (not shown) etc. The means for reducing atmospheric pressure may be located exterior to the inner cavity such as pump 38 in FIG. 1 and FIG. 2 or it may be located within such as in cavity 30 in FIG. 3. The pump means 40 located in cavity 30 is sealed from the nonvented inner cavity (here cavity 28) in which the atmospheric pressure is being lowered. The pump means 40 may be a vacuum pump or a venturi means. Any suitable means is sufficient such as seal means 42 which is intimately arranged about the shaft. The atmospheric pressure in inner cavity 28 however must be reduced to the degree such that air flows in through any lubricant leakage means in the gasket means 22, between the vertically reciprocating needle bar 34 and bushing 36 or seal 42 etc. The air flow can be controlled, by controlling the pump means 40, to effectively block the desired amount of lubricant leakage from the machine's interior to the exterior of the frame. The more the atmospheric pressure is reduced, the greater will be air flow through whatever lubricant leakage means which may exist. A vent means 48 for cavity 30 allows air accumulating in the cavity 30 to return to the surrounding environment.

Thus, the method for reducing leakage of lubricant from a generally sealed machine which has at least one lubricant containing cavity includes the steps of: reducing the atmospheric pressure inside of said lubricant containing cavity sufficiently below that of the surrounding environment by removing therefrom lubricant, lubricant and air or generally just air; and drawing or flowing air from the environment into said lubricant containing cavities through the passages, holes, spaces, means in general through which lubricant leakage occurred thereby avoiding lubricant from being deposited on a workpiece passing through the sewing zone of the machine.

We have thus provided a method and apparatus for retarding the leakage of lubricant from a machine which includes a frame having an open lubricant containing cavity, a cover means removably secured to said frame such that it generally seals the cavity and a means for reducing the atmospheric pressure within the cavity to a degree such that air from the surrounding environment flows into the cavity through whatever means lubricant leakage was occurring.

Thus it is apparent that there has been provided in accordance with the invention, a Method and Apparatus For Retarding Lubricant Leakage In A Sewing Machine that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus having adequately described our invention, what we claim is:

1. A sewing machine having a frame whose interior contains lubricant, sealant means disposed substantially proximate a sewing zone and between the interior of said frame and the outside environment surrounding said frame, and means for retarding lubricant leakage through the sealant means and thereby avoiding its disposition onto a workpiece, comprising:

means independent of said sewing machine for removing a sufficient amount of air from the interior of said machine such that a flow of air from the machine's outside environment is inwardly drawn to the machine's interior through the sealant means to produce an air seal.

2. The means for retarding lubricant leakage of claim 1 wherein said means for removing air from the interior of said frame is a pump means located exterior to said sewing machine.

3. The means for retarding lubricant leakage according to claim 2 wherein said pump means is a vacuum pump means.

4. A sewing machine having a frame a portion of whose interior opens to the surrounding environment in an area defining a sewing zone, covers removably arranged on said frame over such openings to close same, sealant means arranged between said covers and said frame defining gasket junctures, and means for retarding leakage of lubricant from said gasket junctures and around lubricated devices disposed proximate the sewing zone which extend from the machine's interior beyond the machine frame into the surrounding outside environment thereby avoiding lubricant from being deposited onto a workpiece, said means for retarding lubricant leakage comprising:

means independent of said sewing machine for reducing atmospheric pressure within the machine's interior sufficiently below that of the outside environment such that air is inwardly drawn from the outside environment to the machine's interior around the devices and through the gasket junctures to produce an air seal.

5. A sewing machine having a frame with a plurality of inner cavity portion means containing various amounts of lubricant with one of said inner cavity portion means being sealed and nonvented, means for retarding the leakage of lubricant from said sealed and nonvented cavity portion means so as to avoid lubricant deposits onto a workpiece, said means for retarding lubricant leakage comprising:

means independent of said sewing machine for reducing atmospheric pressure within said sealed and nonvented inner cavity portion means below that of the outside environment such that air is inwardly drawn through the means which caused the leakage of lubricant.

6. The means for retarding the leakage of lubricant of claim 5 wherein said means for reducing the atmospheric pressure includes a vacuum pump.

7. A sewing machine comprising:

a frame having an interior portion;

lubricated device means arranged within the sewing machine's interior with a part thereof extending through said frame and generally defining a sewing zone;

lubricated deflector means intimately arranged about that part of the device means extending through said frame in the sewing zone for sealing against lubricant leakage from the machine frame; and means independent of said sewing machine for reducing the pressure in the sewing machine's interior portion to a level whereat it is below that of the surrounding environment whereby air is inwardly drawn to the machine's interior portion across the deflector means to produce an air seal thereby avoiding lubricant from being deposited on a workpiece passing through the sewing zone.

8. A method of reducing leakage of lubrication fluids from a sewing machine whose interior contains lubrication fluids and having mechanism sealant means disposed proximate a sewing zone of the machine, said method comprising the steps of:

reducing the atmospheric pressure in the interior of said sewing machine with means independent of said machine sufficiently below that of the surrounding environment whereby causing air from the outside environment to flow to the sewing machine interior through the mechanism sealant means whereby lubricant leakage occurred thereby avoiding its disposition onto a workpiece.

9. A sewing machine having a frame with a plurality of inner cavity portion means containing various amounts of lubricant with one of said inner cavity portion means being sealed and nonvented, means for retarding the leakage of lubricant from said sewing machine comprising:

means located within one of said inner cavity portion means which is sealed from said other inner cavity portion means and vented to the environment for reducing atmospheric pressure within said sealed and nonvented inner cavity portion below that of the outside environment such that air is inwardly drawn through the means which caused the leakage of lubricant.

* * * * *